US010681937B2

(12) United States Patent
Sebastian et al.

(10) Patent No.: US 10,681,937 B2
(45) Date of Patent: Jun. 16, 2020

(54) FIBROUS FILTRATION MATERIAL FOR ELECTRONIC SMOKING ARTICLE

(71) Applicant: RAI Strategic Holdings, Inc., Winston-Salem, NC (US)

(72) Inventors: Andries Don Sebastian, Clemmons, NC (US); Michael F. Davis, Clemmons, NC (US); Sammy Eni Eni, Winston-Salem, NC (US); Jannell Rowe, Clemmons, NC (US); Tracy M. Hefner, Winston-Salem, NC (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 0 days.

(21) Appl. No.: 16/458,695

(22) Filed: Jul. 1, 2019

(65) Prior Publication Data

US 2019/0320723 A1 Oct. 24, 2019

Related U.S. Application Data

(63) Continuation of application No. 15/616,457, filed on Jun. 7, 2017.

(51) Int. Cl.
*A24F 11/00* (2006.01)
*A24F 47/00* (2006.01)
(Continued)

(52) U.S. Cl.
CPC ..... *A24F 47/008* (2013.01); *A24D 3/10* (2013.01); *A24D 3/12* (2013.01); *A24F 7/04* (2013.01)

(58) Field of Classification Search
CPC ..... A24F 47/008; A24F 47/002; A24F 7/04; A24D 3/10; A24D 3/12
(Continued)

(56) References Cited

U.S. PATENT DOCUMENTS 3,424,172 A 1/1969 Neurath et al.
4,281,671 A 8/1981 Byrne et al.
(Continued)

FOREIGN PATENT DOCUMENTS

WO WO 2010/003480 1/2010
WO WO 2014/182736 11/2014
(Continued)

OTHER PUBLICATIONS

Anselme, J.P., "The Organic Chemistry of N-Nitrosamines: A Brief Review," *ACS Symposium Series*, 1979, vol. 101, pp. 1-10.
(Continued)

*Primary Examiner* — Hae Moon Hyeon
(74) *Attorney, Agent, or Firm* — Womble Bond Dickinson (US) LLP

(57) ABSTRACT

The present disclosure relates to aerosol delivery devices, methods of forming such devices, and elements of such devices. For example, some aerosol delivery devices of the current disclosure include a reservoir having a liquid aerosol precursor composition, an electrical heater in fluid communication with the reservoir and configured to vaporize the liquid aerosol precursor composition to form an aerosol, and a filter operatively arranged relative to the electrical heater such that at least a portion of the formed aerosol passes therethrough, the filter being configured to selectively bind one or more undesirable impurities.

15 Claims, 2 Drawing Sheets

(51) Int. Cl.
*A24D 3/10* (2006.01)
*A24F 7/04* (2006.01)
*A24D 3/12* (2006.01)

(58) Field of Classification Search
USPC ..... 131/328, 329
See application file for complete search history.

(56) References Cited

U.S. PATENT DOCUMENTS 4,700,723 A * 10/1987 Yoshikawa ..... A24D 3/12 131/334
4,735,217 A 4/1988 Gerth et al.
4,756,318 A * 7/1988 Clearman ..... A24F 47/004 131/196
4,811,745 A 3/1989 Cohen et al.
4,850,301 A 7/1989 Greene, Jr. et al.
4,862,905 A 9/1989 Green, Jr. et al.
4,925,602 A 5/1990 Hill et al.
4,947,874 A 8/1990 Brooks et al.
5,060,664 A 10/1991 Siems et al.
5,065,776 A 11/1991 Lawson
5,154,192 A 10/1992 Sprinkel et al.
5,167,764 A 12/1992 Nielsen et al.
5,225,277 A 7/1993 Takegawa et al.
5,261,424 A 11/1993 Sprinkel, Jr.
5,271,419 A * 12/1993 Arzonico ..... A24B 15/14 131/336
5,372,148 A 12/1994 McCafferty et al.
5,387,285 A 2/1995 Rivers
5,776,598 A 7/1998 Huber et al.
5,799,663 A * 9/1998 Gross ..... A24F 47/002 131/270
5,934,289 A 8/1999 Watkins et al.
5,954,979 A 9/1999 Counts et al.
5,967,148 A 10/1999 Harris et al.
6,040,560 A 3/2000 Fleischhauer et al.
6,333,108 B1 12/2001 Wilkes et al.
6,392,033 B1 5/2002 Poggi et al.
6,451,884 B1 9/2002 Cowen et al.
6,503,371 B1 1/2003 Kinseher et al.
6,538,130 B1 3/2003 Fischer et al.
6,803,458 B2 10/2004 Ozaki et al.
7,040,314 B2 5/2006 Nguyen et al.
7,074,170 B2 7/2006 Lanier, Jr. et al.
7,217,320 B2 5/2007 Kim et al.
7,694,827 B2 4/2010 Huber et al.
7,726,320 B2 * 6/2010 Robinson ..... A24F 47/008 131/200
8,205,622 B2 6/2012 Pan
8,365,742 B2 2/2013 Hon
8,402,976 B2 3/2013 Fernando et al.
8,499,766 B1 8/2013 Newton
8,528,569 B1 9/2013 Newton
8,539,959 B1 9/2013 Scatterday
8,910,639 B2 12/2014 Chang et al.
8,910,640 B2 12/2014 Sears et al.
9,078,473 B2 7/2015 Worm et al.
9,279,196 B2 3/2016 Bernt et al.
2009/0230117 A1 9/2009 Fernando et al.
2010/0028766 A1 2/2010 Peckerar et al.
2010/0163063 A1 7/2010 Fernando et al.
2010/0206317 A1 8/2010 Albino
2011/0005534 A1 1/2011 Albino
2012/0255569 A1 10/2012 Beard et al.
2013/0008457 A1 1/2013 Zheng et al.
2013/0192620 A1 8/2013 Tucker
2013/0192623 A1 8/2013 Tucker et al.
2013/0213417 A1 8/2013 Chong et al.
2013/0255702 A1 10/2013 Griffith, Jr. et al.
2013/0298905 A1 11/2013 Levin et al.
2014/0000638 A1 1/2014 Sebastian et al.
2014/0060554 A1 3/2014 Collett et al.
2014/0096781 A1 4/2014 Sears et al.
2014/0147616 A1 5/2014 Bernt et al.
2014/0154507 A1 6/2014 Bernt et al.
2014/0261408 A1 9/2014 DePiano et al.
2014/0261486 A1 9/2014 Potter
2014/0261487 A1 9/2014 Chapman et al.
2014/0261495 A1 9/2014 Novak, III et al.
2014/0270727 A1 9/2014 Ampolini et al.
2014/0308870 A1 10/2014 Harms et al.
2015/0020823 A1 1/2015 Lipowicz et al.
2015/0020825 A1 1/2015 Galloway et al.
2015/0020830 A1 1/2015 Koller
2015/0027454 A1 1/2015 Li
2015/0038648 A1 2/2015 Rees et al.
2015/0114410 A1 4/2015 Doster
2015/0216232 A1 8/2015 Bless et al.
2015/0216233 A1 8/2015 Sears et al.
2015/0245658 A1 9/2015 Worm et al.
2015/0257445 A1 9/2015 Henry, Jr. et al.
2015/0329707 A1 11/2015 Roggenstein et al.
2015/0354095 A1 12/2015 Bernt et al.
2016/0007561 A9 1/2016 Lipscomb
2016/0007654 A1 1/2016 Zhu
2016/0158782 A1 6/2016 Henry, Jr. et al.
2016/0192708 A1 7/2016 DeMeritt et al.
2016/0262454 A1 9/2016 Sears et al.
2018/0352856 A1 * 12/2018 Sebastian ..... A24F 47/008

FOREIGN PATENT DOCUMENTS

WO WO 2015/145165 10/2015
WO WO 2016/009179 1/2016
WO WO 2016/109701 7/2016

OTHER PUBLICATIONS

Chamberlain, W., et al., "Chemical composition of nonsmoking tobacco products," *J. Agric. Food Chem.*, 1988, vol. 36(1), pp. 48-50.
Hecht, S., "Biochemistry, Biology, and Carcinogenicity of Tobacco-Specific N-Nitrosamines," *Chemical Research in Toxicology*, Jun. 1998, vol. 11(6), pp. 559-603.
Tricker, A., et al., "The occurrence of N-nitro compounds in zarda tobacco," Cancer Letters, 1988, vol. 42, Issues 1-2, pp. 113-118.

* cited by examiner

FIBROUS FILTRATION MATERIAL FOR ELECTRONIC SMOKING ARTICLE

CROSS-REFERENCE TO RELATED APPLICATIONS

This application is a continuation of U.S. application Ser. No. 15/616,457; filed Jun. 7, 2017, and which is incorporated by reference herein in its entirety and for all purposes.

FIELD OF THE DISCLOSURE

The present disclosure relates to aerosol delivery devices such as smoking articles, and more particularly to aerosol delivery devices that may utilize electrically generated heat for the production of aerosol (e.g., smoking articles commonly referred to as electronic cigarettes). The smoking articles may be configured to heat an aerosol precursor, which may incorporate materials that may be made or derived from tobacco or otherwise incorporate tobacco, the precursor being capable of forming an inhalable substance for human consumption.

BACKGROUND

Many smoking devices have been proposed through the years as improvements upon, or alternatives to, smoking products that require combusting tobacco for use. Many of those devices purportedly have been designed to provide the sensations associated with cigarette, cigar, or pipe smoking, but without delivering considerable quantities of incomplete combustion and pyrolysis products that result from the burning of tobacco. To this end, there have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices, and heat generating sources set forth in the background art described in U.S. Pat. No. 7,726,320 to Robinson et al., U.S. Pat. Pub. No. 2013/0255702 to Griffith Jr. et al., and U.S. Pat. Pub. No. 2014/0096781 to Sears et al., which are incorporated herein by reference. See also, for example, the various types of smoking articles, aerosol delivery devices, and electrically powered heat generating sources referenced by brand name and commercial source in U.S. Pat. Pub. No. 2015/0216232 to Bless et al., this is incorporated herein by reference in its entirety. Currently numerous aerosol devices are unable to produce a consistent composition of volatile substances throughout their use. In addition, the composition of volatile substances may also contain undesirable impurities originating from the volatile material vaporized in the aerosol delivery device to produce the composition of volatile substances.

It would be highly desirable to provide an electronically-powered aerosol delivery device, for example an electronic cigarette, that is capable of allowing the user thereof to draw aerosol that maintains a consistent flavor profile throughout its use and is devoid of any undesirable impurities; especially impurities which are capable of altering the flavor profile of the aerosol over time.

SUMMARY OF THE DISCLOSURE

The present disclosure relates to aerosol delivery devices, methods of forming such devices, and elements of such devices. In particular, embodiments of the current disclosure are directed towards an aerosol delivery device producing an aerosol comprising minimal amounts of undesirable impurities either formed during aerosol formation or are already present in the liquid aerosol precursor composition.

In aerosol delivery devices a liquid (e.g., liquid aerosol precursor composition) is typically present in a reservoir that is to be vaporized. When a user inhales on the device, a heater is activated to vaporize a small amount of the liquid, which combines with in-drawn air to form an aerosol that is subsequently inhaled by the user. Often the liquid aerosol precursor compositions may already contain some minor undesirable impurities, which can vaporize when heated and becomes part of the aerosol composition. Examples of such undesirable impurities include tobacco-derived nitrosamines (e.g., N-nitrosonornicotine (NNN) and 4-(methylnitrosamino)1-(3-pyridyl)-1-butanone (NNK)).

Other times, although not necessarily expected during normal operation of an aerosol delivery device as described herein, under some conditions it may be possible for a heater (e.g., an electrical heater) to heat the liquid to be vaporized to an extent that some undesirable impurities are formed by the heating. Examples of possible, undesirable impurities include carbonyl-containing compounds (e.g., aldehydes, ketones). As such, it can be beneficial to configure an aerosol delivery device such that any unintentionally formed impurities will be substantially prevented from passing to the consumer in the drawn aerosol.

Aspects of the current disclosure are directed to aerosol delivery devices, which are capable of maintaining a highly flavorful aerosol throughout its use, but are still configured to remove undesirable impurities with the aid of a functionalized filter component.

As such, the first aspect of the current disclosure is directed towards an aerosol delivery device comprising: a reservoir including a liquid aerosol precursor composition; a heater in fluid communication with the reservoir and configured to vaporize the liquid aerosol precursor composition and subsequently form an aerosol; and a filter operatively arranged relative to the heater (e.g., an electrical heater) such that at least a portion of the formed aerosol passes therethrough, the filter being configured to bind selectively one or more target compounds. In some embodiments, the filter comprises cellulose-containing material and ion exchanged fibers. In some embodiments, the amount of cellulose-containing material in the filter ranges from about 1 to about 99% by weight based on the total weight of the filter. In some embodiments, the amount of ion exchanged fiber in the filter ranges from about 1 to about 99% by weight based on the total weight of the filter. In some embodiments, the cellulose-containing material comprises one or more of cellulose acetate, cellulose triacetate, cellulose propionate, cellulose acetate propionate, cellulose acetate butyrate, nitrocellulose, cellulose sulfate, methyl cellulose, ethyl cellulose, hydroxyethyl cellulose, hydroxypropyl cellulose, hydroxyethylmethyl cellulose, hydroxypropylmethyl cellulose, ethylhydroxyethyl cellulose, carboxymethyl cellulose, and regenerated cellulose fibers. In some embodiments, the cellulose-containing material is cellulose acetate. In some embodiments, the ion exchanged fibers include nucleophilic functional groups selected from a primary amino group, a secondary amino group, a tertiary amino group, a hydrazine group, a benzenesulfonyl hydrazine group and combinations thereof. In some embodiments, the nucleophilic functional groups are a primary amine group or a secondary amine group. In some embodiments, the nucleophilic functional groups are present in the ion exchanged fibers in an amount ranging from about 0.5 mmol/g to about 5 mmol/g. In some embodiments, the nucleophilic functional groups are present in the ion exchanged fiber in an amount of at least 20% by weight based on the total weight of the ion exchanged fiber.

In some embodiments, the target compounds comprise electrophilic functional groups. In some embodiments, the target compounds comprise carbonyl-containing compounds. In some embodiments, the carbonyl-containing compounds comprise aldehydes, ketones, or combinations thereof. In some embodiments, the carbonyl-containing compounds are at least one aldehyde. In some embodiments, the aldehyde comprises at least one or more of acetaldehyde, acrolein, butyraldehyde, crotonaldehyde, formaldehyde, or propionaldehyde.

In some embodiments, the target compounds comprise nitroso-containing compounds. In some embodiments, the nitroso-containing compounds comprise N'-nitrosonornicotine (NNN), N'-nitrosoanatabine (NAT), N'-nitrosoanabasine (NAB), 4-(N-nitrosomethylamino)-1-(3-pyridyl)-1-butanone (NNK), 4-(N-nitrosomethylamino)-4-(3-pyridyl)-1-butanal (NNA), 4-(N-nitrosomethylamino)-1-(3-pyridyl)-1-butanol (NNAL), 4-(N-nitrosomethylamino)-4-(3-pyridyl)-1-butanol (iso-NNAL), 4-(N-nitrosomethylamino)-4-(3-pyridyl)-butanoic acid (iso-NNAC), or combinations thereof.

In some embodiments, the heater and the reservoir are present in a housing. In some embodiments, the filter is included within the housing downstream of the heater. In some embodiments, the filter is positioned within a removable mouthpiece configured to engage a mouthend of the housing. In some embodiments, the mouthpiece is disposable.

Another aspect of the invention is directed to a method for removing target compounds from a formed aerosol, the method comprising: configuring a filter relative to a heater in an aerosol delivery device such that the aerosol formed in the aerosol delivery device by heating of an aerosol precursor composition by a heater is passed through the filter and one or more target compounds is bound by the filter.

In some embodiments, the filter contacts the formed aerosol and adsorbs target compounds in an amount ranging from about 0.2 μg to about 750 μg upon completion of use of the device. In some embodiments, the removal of target compounds is determined by measuring a reduction in levels of target compounds present in the aerosol before contact with the filter and after contact with filter. In some embodiments, the level of target compounds comprising one or more aldehydes is reduced by at least 50%, compared to the level of one or more aldehydes before contact with the filter.

BRIEF DESCRIPTION OF THE FIGURES

Figure 1:
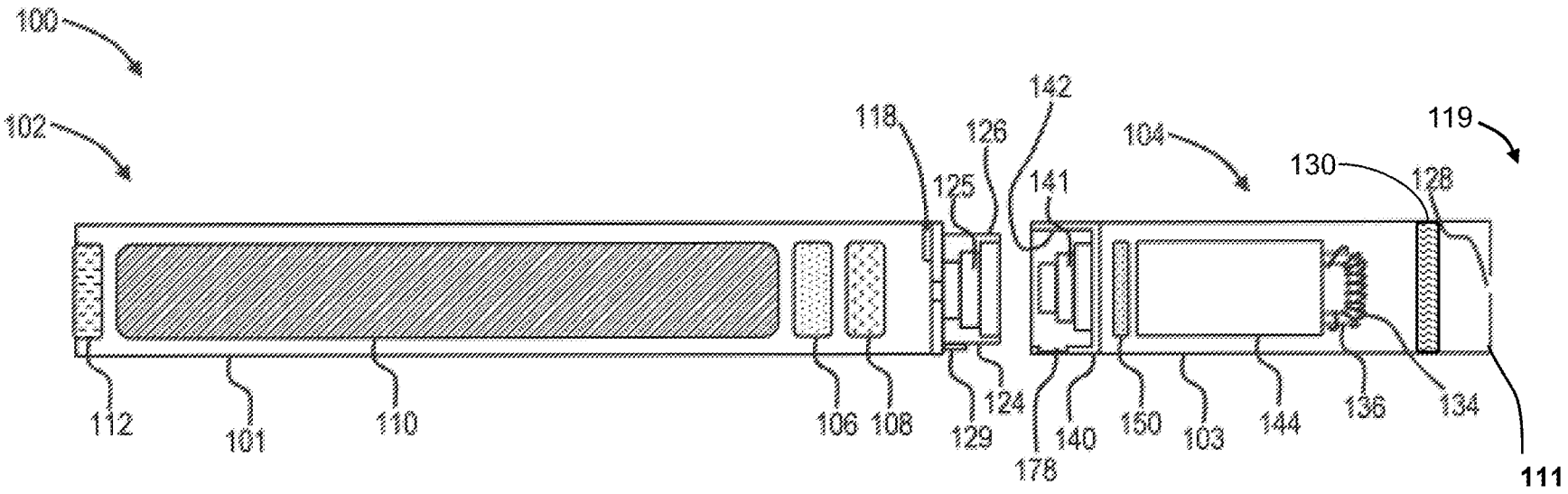
Figure 2:
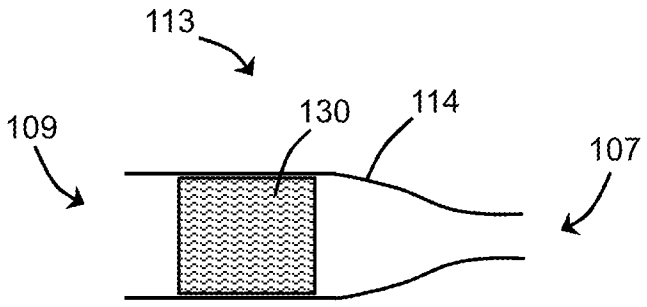

Having thus described the disclosure in the foregoing general terms, reference will now be made to the accompanying drawings, which are not necessarily drawn to scale, and wherein:

FIG. 1 is a partially cut-away view of an aerosol delivery device comprising a cartridge and a control body including a variety of elements that may be utilized in an aerosol delivery device according to various embodiments of the present disclosure; and FIG. 2 is a partially cut-away view of a cartridge and an attachable mouthpiece of an aerosol delivery device including a variety of elements that may be utilized in an aerosol delivery device according to various embodiments of the present disclosure.

DETAILED DESCRIPTION

The present disclosure will now be described more fully hereinafter with reference to exemplary embodiments thereof. These exemplary embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification, and in the appended claims; the singular forms "a", "an", "the", include plural referents unless the context clearly dictates otherwise.

As described herein the present disclosure is directed to aerosol delivery devices designed to bind undesired compounds in vapor or aerosol released prior to contact with the consumer. These undesired compounds are either (a) impurities in the liquid aerosol precursor vaporized during use; or (b) are impurities formed during use of the aerosol delivery device.

For example, impurities in the liquid aerosol precursor are often derived from the nicotine extract present in the liquid aerosol precursor. Nicotine extract isolated from natural sources and is often accompanied by tobacco specific nitrosamines (TSNAs). TSNAs are considered undesirable constituents found in tobacco plant parts (e.g., leaves, stem), but can also in addition be produced during the processing of such tobacco plant parts. For example, it has been observed that TSNAs form during the post-harvest processing to which tobacco is subjected. See, Tricker, A. *Canc. Len.* 1998, 42, 113-118; Chamberlain, W. et al. *J. Agric. Food Chem.* 1988, 36, 48-50, which is hereby incorporated by reference in its entirety. Tobacco alkaloids, such as nicotine and nornicotine, are nitrosated to form TSNAs. During nitrosation the amine functional group of, for example, nicotine and nornicotine reacts with nitrous oxide to form a nitrosoamine ($R_1N(R_2)N{=}O$, wherein $R_1$ and $R_2$ represent alkyl substituents). This nitrosation may occur during the processing and storage of tobacco, and by combustion of tobacco containing nicotine and nornicotine in a nitrate-rich environment. Exemplary TSNAs are N'-nitrosonornicotine (NNN), N'-nitrosoanatabine (NAT), N'-nitrosoanabasine (NAB), 4-(N-nitrosomethylamino)-1-(3-pyridyl)-1-butanone (NNK), 4-(N-nitrosomethylamino)-4-(3-pyridyl)-1-butanal (NNA), 4-(N-nitrosomethylamino)-1-(3-pyridyl)-1-butanol (NNAL), 4-(N-nitrosomethylamino)-4-(3-pyridyl)-1-butanol (iso-NNAL), and 4-(N-nitrosomethylamino)-4-(3-pyridyl)-butanoic acid (iso-NNAC). The two TSNAs of greatest concern are N'-nitrosonornicotine (NNN) and 4-(N-nitrosomethylamino)-1-(3-pyridyl)-1-butanone (NNK). Of these two, NNK is of the greatest concern. See, for example, Hecht, S. *Chem. Res. Toxicol.* 1998, 11, 6, 559-603, which is hereby incorporated by references in its entirety. The nitrosamine functional group of one or more TSNAs, however, is able to rearrange and release nitrogen monoxide (NO) forming a TSNA derivative containing an amine functionality. This rearrangement can occur at room temperature but is more frequently occurs at elevated temperatures. See, for example, Anselme, J.-P. *ACS Symposium Series,* 1979, 1-10 and Lijnsky, W., *Chemistry and Biology of N-Nitroso Compounds*, Cambridge University Press, 1992, which are hereby incorporated by reference in their entireties.

The amount of TSNAs present in liquid aerosol precursor is dependent upon the processing methods used for the tobacco from which the extract was isolated from. For example, pharmaceutical grade nicotine being synthetically derived or undergoing extensive purification of naturally derived tobacco often contains the lowest amount of TSNAs.

Undesired compounds can not only be present in the liquid aerosol precursor to be vaporized but can also be formed during use of conventional aerosol delivery devices. The liquid to be vaporized can experience temperature fluctuations when heated resulting in the formation of undesirable impurities that can impact the overall flavor profile of the generated aerosol and can also be undesirable for delivery to a consumer upon inhalation.

Present devices include immobilized supports, which target and bind undesired compounds also often referred to as target compounds in the aerosol as the aerosol passes through the various components of the device. The immobilized support can be incorporated into any component of the device such as but not limited to the filter element. In some embodiments, the filter element comprising the immobilized support attracts and binds target compounds using a chemisorption process, wherein the gaseous target compounds are directed to the surface of the immobilized support, then adsorbed onto the surface, and subsequently covalently bound to the surface thereby removing such compounds from the mainstream aerosol. While the target compounds are bound to the immobilized support, the treated aerosol continues to pass through the remaining components of the device to reach the consumer.

Without intending to be bound by theory, it is thought that functional groups of the target compounds undergo a chemical reaction with functional groups on the surface of the immobilized support to form a covalent bond between the immobilized support and the undesired compound. In general, chemisorption processes are based on the attraction and subsequent binding of functional groups with opposite charge, e.g., nucleophilic functional groups bind with electrophilic functional groups and vice versa. As such, the immobilized support in the filter element can be modified to contain either electrophilic or nucleophilic functional groups, which are able to attract and bind target compounds containing functional groups of opposite charge. For example, immobilized supports in a filter element modified with electrophilic functional groups are able to attract and bind target compounds containing nucleophilic functional groups. In some embodiments target compounds with nucleophilic functional groups are amine-containing compounds (e.g., TSNA derivatives). Immobilized supports comprising electrophilic functional groups (e.g., aldehydes, alkyl halides) can be used to attract and covalently bind such amine-containing compounds to the immobilized support thereby removing such species from the mainstream aerosol. In contrast, immobilized supports in filter elements modified with nucleophilic groups are able to attract and bind target compounds containing electrophilic functional groups. For example, in some embodiments target compounds with electrophilic functional groups are carbonyl-containing compounds (e.g., aldehydes and/or ketones) and/or nitroso-containing compounds (e.g., TSNAs). The reactivity of carbonyl-containing compounds and nitroso-containing compounds towards nucleophiles is similar and thus the same nucleophilic functional groups can often be used to attract carbonyl- and nitroso-containing compounds. Such nucleophilic functional groups (e.g., amines and/or alcohols) are immobilized onto a support to attract and covalently bind carbonyl-containing compounds and/or nitroso-containing compounds onto the support thereby removing such species from the mainstream aerosol. As such, this binding process of the immobilized support in the filter element is typically selective towards target compounds with functional groups opposite in charge with respect to the charge carried by the immobilized support.

As described hereinafter, embodiments of the present disclosure relate to aerosol delivery systems. Aerosol delivery systems according to the present disclosure use electrical energy to heat a material (preferably without combusting the material to any significant degree and/or without significant chemical alteration of the material) to form an inhalable substance; and components of such systems have the form of articles that most preferably are sufficiently compact to be considered hand-held devices. That is, use of components of preferred aerosol delivery systems does not result in the production of smoke—i.e., from by-products of combustion or pyrolysis of tobacco, but rather, use of those preferred systems results in the production of aerosol resulting from volatilization or vaporization of certain components incorporated therein. In preferred embodiments, components of aerosol delivery systems may be characterized as electronic cigarettes, and those electronic cigarettes most preferably incorporate tobacco and/or components derived from tobacco, and hence deliver tobacco derived components in aerosol form.

Aerosol generating pieces of certain preferred aerosol delivery systems may provide many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe that is employed by lighting and burning tobacco (and hence inhaling tobacco smoke), without any substantial degree of combustion of any component thereof. For example, the user of an aerosol generating piece of the present disclosure can hold and use that piece much like a smoker employs a traditional type of smoking article, draw on one end of that piece for inhalation of aerosol produced by that piece, take or draw puffs at selected intervals of time, and the like.

Aerosol delivery devices of the present disclosure also can be characterized as being vapor-producing articles or medicament delivery articles. Thus, such articles or devices can be adapted so as to provide one or more substances (e.g., flavors and/or pharmaceutical active ingredients) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas). For purposes of simplicity, the term "aerosol" as used herein is meant to include vapors, gases, and aerosols of a form or type suitable for human inhalation, whether or not visible, and whether or not of a form that might be considered to be smoke-like.

Aerosol delivery devices of the present disclosure generally include a number of components provided within an outer body or shell, which may be referred to as a housing. The overall design of the outer body or shell can vary, and the format or configuration of the outer body that can define the overall size and shape of the aerosol delivery device can vary. Typically, an elongated body resembling the shape of a cigarette or cigar can be a formed from a single, unitary housing, or the elongated housing can be formed of two or more separable bodies. For example, an aerosol delivery device can comprise an elongated shell or body that can be substantially tubular in shape and, as such, resemble the shape of a conventional cigarette or cigar. In one embodiment, all of the components of the aerosol delivery device are contained within one housing. Alternatively, an aerosol delivery device can comprise two or more housings that are joined and are separable. For example, an aerosol delivery device can possess at one end a control body comprising a housing containing one or more components (e.g., a battery and various electronics for controlling the operation of that article), and at the other end and removably attached thereto an outer body or shell containing aerosol forming components (e.g., one or more aerosol precursor components, such as flavors and aerosol formers, one or more heaters, and/or one or more wicks).

Aerosol delivery devices of the present disclosure can be formed of an outer housing or shell that is not substantially tubular in shape but may be formed to substantially greater dimensions. The housing or shell can be configured to include a mouthpiece and/or may be configured to receive a separate shell (e.g., a cartridge or tank) that can include consumable elements, such as a liquid aerosol former, and can include a vaporizer or atomizer.

Aerosol delivery devices of the present disclosure most preferably comprise some combination of a power source (i.e., an electrical power source), at least one control component (e.g., means for actuating, controlling, regulating and ceasing power for heat generation, such as by controlling electrical current flow from the power source to other components of the article—e.g., a microcontroller or microprocessor), a heater or heat generation member e.g., an electrical resistance heating element or other component, which alone or in combination with one or more further elements may be commonly referred to as an "atomizer"), an aerosol precursor composition (e.g., commonly a liquid capable of yielding an aerosol upon application of sufficient heat, such as ingredients commonly referred to as "smoke juice," "e-liquid" and "e-juice"), and a mouthpiece or mouth region for allowing draw upon the aerosol delivery device for aerosol inhalation (e.g., a defined airflow path through the article such that aerosol generated can be withdrawn therefrom upon draw).

More specific formats, configurations and arrangements of components within the aerosol delivery systems of the present disclosure will be evident in light of the further disclosure provided hereinafter. Additionally, the selection and arrangement of various aerosol delivery system components can be appreciated upon consideration of the commercially available electronic aerosol delivery devices, such as those representative products referenced in the background art section of the present disclosure.

One example embodiment of an aerosol delivery device 100 illustrating components that may be utilized in an aerosol delivery device according to the present disclosure is provided in FIG. 1. As seen in the cut-away view illustrated therein, the aerosol delivery device 100 can comprise a control body 102 and a cartridge 104 that can be permanently or detachably aligned in a functioning relationship. Engagement of the control body 102 and the cartridge 104 can be press fit (as illustrated), threaded, interference fit, magnetic, or the like. In particular, connection components, such as further described herein may be used. For example, the control body may include a coupler that is adapted to engage a connector on the cartridge.

In specific embodiments, one or both of the control body 102 and the cartridge 104 may be referred to as being disposable or as being reusable. For example, the control body may have a replaceable battery or a rechargeable battery and thus may be combined with any type of recharging technology, including connection to a typical electrical outlet, connection to a car charger (i.e., cigarette lighter receptacle), and connection to a computer, such as through a universal serial bus (USB) cable. For example, an adaptor including a USB connector at one end and a control body connector at an opposing end is disclosed in U.S. Pat. Pub. No. 2014/0261495 to Novak et al., which is incorporated herein by reference in its entirety. Further, in some embodiments the cartridge may comprise a single-use cartridge, as disclosed in U.S. Pat. No. 8,910,639 to Chang et al., which is incorporated herein by reference in its entirety.

As illustrated in FIG. 1, a control body 102 can be formed of a control body shell 101 that can include a control component 106 (e.g., a printed circuit board (PCB), an integrated circuit, a memory component, a microcontroller, or the like), a flow sensor 108, a battery 110, and a Light Emitting Diode (LED) 112, and such components can be variably aliened. Further indicators (e.g., a haptic feedback component, an audio feedback component, or the like) can be included in addition to or as an alternative to the LED. Additional representative types of components that yield visual cues or indicators, such as LED components, and the configurations and uses thereof, are described in U.S. Pat. No. 5,154,192 to Sprinkel et al.; U.S. Pat. No. 8,499,766 to Newton and U.S. Pat. No. 8,539,959 to Scatterday; U.S. Pat. Pub. No. 2015/0020825 to Galloway et al.; and U.S. Pat. Pub. No. 2015/0216233 to Sears et al.; which are incorporated herein by reference in their entireties.

A cartridge 104 can be formed of a cartridge shell 103 enclosing the reservoir 144 that is in fluid communication with a liquid transport element 136 adapted to wick or otherwise transport an aerosol precursor composition stored in the reservoir housing to a heater 134. A liquid transport element can be formed of one or more materials configured for transport of a liquid, such as by capillary action. A liquid transport element can be formed of, for example, fibrous materials (e.g., organic cotton, cellulose acetate, regenerated cellulose fabrics, glass fibers), porous ceramics, porous carbon, graphite, porous glass, sintered glass beads, sintered ceramic beads, capillary tubes, or the like. The liquid transport element thus can be any material that contains an open pore network (i.e., a plurality of pores that are interconnected so that fluid may flow from one pore to another in a plurality of direction through the element). Various embodiments of materials configured to produce heat when electrical current is applied therethrough may be employed to form the resistive heater 134. Example materials from which the wire coil may be formed include Kanthal (FeCrAl), Nichrome, Molybdenum disilicide ($MoSi_2$), molybdenum suicide (MoSi), Molybdenum disilicide doped with Aluminum ($Mo(Si,Al)_2$), titanium, platinum, silver, palladium, graphite and graphite-based materials (e.g., carbon-based foams and yarns) and ceramics (e.g., positive or negative temperature coefficient ceramics). In some embodiments, heater 134 is an electrical heater.

An opening 128 may be present in the cartridge shell 103 (e.g., at the mouthend) to allow for egress of formed aerosol from the cartridge 104. Such components are representative of the components that may be present in a cartridge and are not intended to limit the scope of cartridge components that are encompassed by the present disclosure.

The cartridge 104 also may include one or more electronic components 150, which may include an integrated circuit, a memory component, a sensor, or the like. The electronic component 150 may be adapted to communicate with the control component 106 and/or with an external device by wired or wireless means. The electronic component 150 may be positioned anywhere within the cartridge 104 or its base 140.

Although the control component 106 and the flow sensor 108 are illustrated separately, it is understood that the control component and the flow sensor may be combined as an electronic circuit board with the air flow sensor attached directly thereto. Further, the electronic circuit board may be positioned horizontally relative the illustration of FIG. 1 in that the electronic circuit board can be lengthwise parallel to the central axis of the control body. In some embodiments, the air flow sensor may comprise its own circuit board or other base element to which it can be attached. In some embodiments, a flexible circuit board may be utilized. A flexible circuit board may be configured into a variety of shapes, include substantially tubular shapes.

The control body 102 and the cartridge 104 may include components adapted to facilitate a fluid engagement therebetween. As illustrated in FIG. 1, the control body 102 can include a coupler 124 having a cavity 125 therein. The cartridge 104 can include a base 140 adapted to engage the coupler 124 and can include a projection 141 adapted to fit within the cavity 125. Such engagement can facilitate a stable connection between the control body 102 and the cartridge 104 as well as establish an electrical connection between the battery 110 and control component 106 in the control body and the heater 134 in the cartridge. Further, the control body shell 101 can include an air intake 118, which may be a notch in the shell where it connects to the coupler 124 that allows for passage of ambient air around the coupler and into the shell where it then passes through the cavity 125 of the coupler and into the cartridge through the projection 141.

A coupler and a base useful according to the present disclosure are described in U.S. Pat. Pub. No. 2014/0261495 to Novak et al., the disclosure of which is incorporated herein by reference in its entirety. For example, a coupler as seen in FIG. 1 may define an outer periphery 126 configured to mate with an inner periphery 142 of the base 140. In one embodiment the inner periphery of the base may define a radius that is substantially equal to, or slightly greater than, a radius of the outer periphery of the coupler. Further, the coupler 124 may define one or more protrusions 129 at the outer periphery 126 configured to engage one or more recesses 178 defined at the inner periphery of the base. However, various other embodiments of structures, shapes, and components may be employed to couple the base to the coupler. In some embodiments the connection between the base 140 of the cartridge 104 and the coupler 124 of the control body 102 may be substantially permanent, whereas in other embodiments the connection therebetween may be releasable such that, for example, the control body may be reused with one or more additional cartridges that may be disposable and/or refillable.

The aerosol delivery device 100 may be substantially rod-like or substantially tubular shaped or substantially cylindrically shaped in some embodiments. In other embodiments, further shapes and dimensions are encompassed—e.g., a rectangular or triangular cross-section, multifaceted shapes, or the like. In particular, the control body 102 may be non-rod-like and may rather be substantially rectangular, round, or have some further shape. Likewise, the control body 102 may be substantially larger than a control body that would be expected to be substantially the size of a conventional cigarette.

The reservoir 144 illustrated in FIG. 1 can be a container (e.g., formed of walls substantially impermeable to the aerosol precursor composition) or can be a fibrous reservoir. For example, the reservoir 144 can comprise one or more layers of nonwoven fibers substantially formed into the shape of a tube encircling the interior of the cartridge shell 103, in this embodiment. An aerosol precursor composition can be retained in the reservoir 144. Liquid components, for example, can be sorptively retained by the reservoir 144. The reservoir 144 can be in fluid connection with a liquid transport element 136. The liquid transport element 136 can transport the aerosol precursor composition stored in the reservoir 144 via capillary action to the heater 134 that is in the form of a metal wire coil in this embodiment. As such, the heater 134 is in a heating arrangement with the liquid transport element 136.

An input element may be included with the aerosol delivery device. The input may be included to allow a user to control functions of the device and/or for output of information to a user. Any component or combination of components may be utilized as an input for controlling the function of the device. For example, one or more pushbuttons may be used as described in U.S. Pat. Pub. No. 2015/0245658 to Worm et al., which is incorporated herein by reference in its entirety. Likewise, a touchscreen may be used as described in U.S. Pat. Pub. No. 2016/0262454 to Sears et al., which are incorporated herein by reference in their entireties. As a further example, components adapted for gesture recognition based on specified movements of the aerosol delivery device may be used as an input. See U.S. Pat. Pub. No. 2016/0158782 to Henry et al., which is incorporated herein by reference in its entirety.

In some embodiments, an input may comprise a computer or computing device, such as a smartphone or tablet. In particular, the aerosol delivery device may be wired to the computer or other device, such as via use of a USB cord or similar protocol. The aerosol delivery device also may communicate with a computer or other device acting as an input via wireless communication. See, for example, the systems and methods for controlling a device via a read request as described in U.S. Pat. Pub. No. 2016/0007561 to Ampolini et al., this is hereby incorporated by reference in its entirety. In such embodiments, an APP or other computer program may be used in connection with a computer or other computing device to input control instructions to the aerosol delivery device, such control instructions including, for example, the ability to form an aerosol of specific composition by choosing the nicotine content and/or content of further flavors to be included.

The various components of an aerosol delivery device according to the present disclosure can be chosen from components described in the art and commercially available. Examples of batteries that can be used according to the disclosure are described in U.S. Pat. Pub. No. 2010/0028766 to Peckerar et al., this is incorporated herein by reference in its entirety.

The aerosol delivery device can incorporate a sensor or detector for control of supply of electric power to the heat generation element when aerosol generation is desired (e.g., upon draw during use). As such, for example, there is provided a manner or method for turning off the power supply to the heat generation element when the aerosol delivery device is not be drawn upon during use, and for turning on the power supply to actuate or trigger the generation of heat by the heat generation element during draw. Additional representative types of sensing or detection mechanisms, structure and configuration thereof, components thereof, and general methods of operation thereof, are described in U.S. Pat. No. 5,261,424 to Sprinkel, Jr.; U.S. Pat. No. 5,372,148 to McCafferty et al.; and PCT WO 2010/003480 to Flick; which are incorporated herein by reference in their entireties.

The aerosol delivery device most preferably incorporates a control mechanism for controlling the amount of electric power to the heat generation element during draw. Representative types of electronic components, structure and configuration thereof, features thereof, and general methods of operation thereof, are described in U.S. Pat. No. 4,735,217 to Gerth et al.; U.S. Pat. No. 4,947,874 to Brooks et al.; U.S. Pat. No. 5,372,148 to McCafferty et al.; U.S. Pat. No. 6,040,560 to Fleischhauer et al.; U.S. Pat. No. 7,040,314 to Nguyen et al. and U.S. Pat. No. 8,205,622 to Pan; U.S. Pat. Pub. Nos. 2009/0230117 to Fernando et al., 2014/0060554 to Collet et al., and 2014/0270727 to Ampolini et al.; and U.S. Pub. No. 2015/0257445 to Henry et al.; which are incorporated herein by reference.

Representative types of substrates, reservoirs or other components for supporting the aerosol precursor are described in U.S. Pat. No. 8,528,569 to Newton; U.S. Pat. Pub. Nos. 2014/0261487 to Chapman et al.; 2014/0059780 to Davis et al.; and 2015/0216232 to Bless et al.; which are incorporated herein by reference in their entireties. Additionally, various wicking materials, and the configuration and operation of those wicking materials within certain types of electronic cigarettes, are set forth in U.S. Pat. No. 8,910,640 to Sears et al.; which is incorporated herein by reference in its entirety.

Yet other features, controls or components that can be incorporated into aerosol delivery devices of the present disclosure are described in U.S. Pat. No. 5,967,148 to Harris et al.; U.S. Pat. No. 5,934,289 to Watkins et al.; U.S. Pat. No. 5,954,979 to Counts et al.; U.S. Pat. No. 6,040,560 to Fleischhauer et al.; U.S. Pat. No. 8,365,742 to Hon; U.S. Pat. No. 8,402,976 to Fernando et al.; U.S. Pat. Pub. Nos. 2010/0163063 to Fernando et al.; 2013/0192623 to Tucker et al.; 2013/0298905 to Leven et al.; 2013/0180553 to Kim et al.; 2014/0000638 to Sebastian et al.; 2014/0261495 to Novak et al.; and 2014/0261408 to DePiano et al.; which are incorporated herein by reference in their entireties.

For aerosol delivery systems that are characterized as electronic cigarettes, the aerosol precursor composition most preferably incorporates tobacco or components derived from tobacco. In one regard, the tobacco may be provided as parts or pieces of tobacco, such as finely ground, milled or powdered tobacco lamina. In another regard, the tobacco may be provided in the form of an extract, such as a spray dried extract that incorporates many of the water soluble components of tobacco. Alternatively, tobacco extracts may have the form of relatively high nicotine content extracts, which extracts also incorporate minor amounts of other extracted components derived from tobacco. In another regard, components derived from tobacco may be provided in a relatively pure form, such as certain flavoring agents that are derived from tobacco. In one regard, a component that is derived from tobacco, and that may be employed in a highly purified or essentially pure form, is nicotine (e.g., pharmaceutical grade nicotine).

The aerosol precursor composition, also referred to as a vapor precursor composition, may comprise a variety of components including, by way of example, a polyhydric alcohol (e.g., glycerin, propylene glycol, or a mixture thereof), nicotine, tobacco, tobacco extract, and/or flavorants. Representative types of aerosol precursor components and formulations also are set forth and characterized in U.S. Pat. No. 7,217,320 to Robinson et al. and U.S. Pat. Pub. Nos. 2013/0008457 to Zheng et al.; 2013/0213417 to Chong et al.; 2014/0060554 to Collett et al.; 2015/0020823 to Lipowicz et al.; and 2015/0020830 to Koller, as well as WO 2014/182736 to Bowen et al, which are incorporated herein by reference in their entireties. Other aerosol precursors that may be employed include the aerosol precursors that have been incorporated in the VUSE® product by R. J. Reynolds Vapor Company, the BLU™ product by Lorillard Technologies, the MISTIC MENTHOL product by Mistic Ecigs, and the VYPE product by CN Creative Ltd. Also desirable are the so-called "smoke juices" for electronic cigarettes that have been available from Johnson Creek Enterprises LLC.

The amount of aerosol precursor that is incorporated within the aerosol delivery system is such that the aerosol generating piece provides acceptable sensory and desirable performance characteristics. For example, it is highly preferred that sufficient amounts of aerosol forming material (e.g., glycerin and/or propylene glycol), be employed in order to provide for the generation of a visible mainstream aerosol that in many regards resembles the appearance of tobacco smoke. The amount of aerosol precursor within the aerosol generating system may be dependent upon factors such as the number of puffs desired per aerosol generating piece. Typically, the amount of aerosol precursor incorporated within the aerosol delivery system, and particularly within the aerosol generating piece, is less than about 2 g, generally less than about 1.5 g, often less than about 1 g and frequently less than about 0.5 g.

Yet other features, controls or components that can be incorporated into aerosol delivery systems of the present disclosure are described in U.S. Pat. No. 5,967,148 to Harris et al.; U.S. Pat. No. 5,934,289 to Watkins et al.; U.S. Pat. No. 5,954,979 to Counts et al.; U.S. Pat. No. 6,040,560 to Fleischhauer et al.; U.S. Pat. No. 8,365,742 to Hon; U.S. Pat. No. 8,402,976 to Fernando et al.; U.S. Pat. Pub. Nos. 2010/0163063 to Fernando et al.; 2013/0192623 to Tucker et al.; 2013/0298905 to Leven et al.; 2013/0180553 to Kim et al.; 2014/0000638 to Sebastian et al.; 2014/0261495 to Novak et al.; and 2014/0261408 to DePiano et al.; which are incorporated herein by reference in their entireties.

The foregoing description of use of the article can be applied to the various embodiments described herein through minor modifications, which can be apparent to the person of skill in the art in light of the further disclosure provided herein. The above description of use, however, is not intended to limit the use of the article but is provided to comply with all necessary requirements of disclosure of the present disclosure. Any of the elements shown in the article illustrated in FIG. 1 or as otherwise described above may be included in an aerosol delivery device according to the present disclosure.

During use of the aerosol delivery device (e.g., electronic cigarettes), it is possible for impurities to be formed. For example, uncontrolled heating of the aerosol precursor composition can result in oxidation of various components present within the aerosol precursor compositions (e.g., glycerol, propylene glycerol) to generate oxygen rich target compounds, carbonyl-containing compounds (such as aldehydes and/or ketones), in various amounts depending on the composition of the aerosol precursor. Unlike tobacco cigarettes, which are burned continuously at similar temperatures during the whole time of use, aerosol delivery devices can undergo repeated thermal cycles of heating and cooling.

Upon activation of the device, energy is supplied to the heating element to heat and vaporize the liquid aerosol precursor composition in the liquid transport element. After the consumer has completed the puff, no more energy is delivered to the heating element and wick and the temperature gradually decreases while at the same time the liquid aerosol precursor is re-supplied to the wick. During use it is possible to have an insufficient supply of liquid aerosol precursor to the liquid transport element, which can result in overheating of the liquid aerosol precursor by the heating element, which may not recognize a decrease in liquid precursor composition availability. However, overheating of the liquid aerosol precursor can result in the development of a strong unpleasant taste that can be detected by the consumer, which is due to the presence of undesirable impurities (e.g., oxygen rich target compounds such as carbonyl-containing compounds) being formed.

Another example for impurities to be formed during use of the aerosol delivery device is upon vaporization of the liquid aerosol precursor composition containing minor amounts of TSNAs. TSNAs are often present as minor impurities in nicotine extract (isolated from tobacco) used in liquid aerosol precursor composition. These impurities are vaporized during use of the aerosol delivery device along with all the other components in the liquid aerosol precursor composition. In some embodiments, TSNAs rearrange to release nitrogen monoxide (NO) forming amine-containing TSNA derivatives (e.g., containing a primary or secondary amine functionality).

In one or more embodiments, the present disclosure particularly relates to an aerosol delivery device comprising a filter element, as shown in an exemplary embodiment in FIG. 1. The filter element 130 can be present in the cartridge 104 located downstream of the heating element 134 and the liquid transport element 136 but upstream of the opening 128 at the mouth end 111. The filter element is adapted to bind one or more target compounds in the formed aerosol, as the aerosol passes through the filter before reaching the mouth end 111 (i.e., consumer). The filter can be in the form of a pressure fitted plug or can be held in place by features within the structure of the cartridge 104. The filter can be made from a variety of fibers (e.g., cellulose-containing fibers, ion-exchanged fibers), having enough porosity to minimize the pressure drop across the filter when the consumer draws on the mouthend 111 of the device.

In some embodiments, as is illustrated in FIG. 2 the filter element 130 can be positioned in a slideable engaging mouthpiece 113 that can be permanently or detachably aligned in a functioning relationship to a cartridge, e.g., cartridge 104 in FIG. 1. The filter element 130 is surrounded by wall 114, which provides the shape of mouthpiece 113. The first end 109 and the second end 107 are open, wherein the first end 109 engages with the mouthend of the aerosol delivery device while the second end 107 provides an egress for the aerosol to exit the delivery device. In some embodiments, the mouthpiece 113, containing the filter element 130, may be engaged with the mouth end 111 of the cartridge 104.

The filter element 130 partially captures target compounds present in the aerosol exiting the opening 128 of cartridge 104 and entering the mouthpiece 113 via the first end 109. In order to capture such target compounds, the filter element 130 contains either electrophilic or nucleophilic functional groups, which are able to attract and bind target compounds containing functional groups of opposite charge. A filter element containing electrophilic functional groups is able to attract and bind target compounds containing nucleophilic functional groups. For example, derivatives of TSNAs (e.g., anabasine, anatabine, nornicotine, 4-(methylamino)-1-(3-pyridyl)-1-butanone) containing an amine functional group can be captured with electrophilic functional groups such as, but not limited to, aldehydes, alkyl halides, or alkyl sulfonates. In contrast, filter elements containing nucleophilic functional groups are able to attract and bind target compounds containing electrophilic functional groups. In some embodiments, target compounds are carbonyl-containing compounds (e.g., aldehydes and/or ketones) and/or nitroso-containing compounds (TSNAs), which are electrophilic in nature and as such the filter element 130 contains nucleophilic functional groups (e.g., amines and/or alcohols) to attract and covalently bind such carbonyl-containing compounds and/or nitroso-containing compounds to the filter element 130 thereby removing such species from the mainstream aerosol. In this manner, target compounds can be removed selectively from the mainstream aerosol depending on the functional groups, i.e., nucleophilic or electrophilic, present in the filter element. As such a skilled person in the art is able to direct the selective removal of target compounds over other components present in the aerosol, e.g., flavoring compounds and/or other aerosol ingredients, by modifying the functional groups of the filter element 130. The position of filter 130 is located relative to the heater 134 such that at least a portion of the formed aerosol passes through filter 130 and as such one or more target compounds are bound by the filter. As the aerosol passes through the filter element 130, wherein the target compounds (e.g., carbonyl-containing compounds and/or nitroso-containing compounds) are bound onto the filter while the remaining aerosol composition exits the mouthpiece 113 via opening at the first end 107 to reach the consumer. In some embodiments, the mouthpiece 113 can be disposable and discarded after use.

According to the disclosed embodiments as illustrated in FIG. 1 and FIG. 2 or a suitable alternative, the filter element 130 can generally be manufactured from any cellulose-containing material in combination with an ion exchanged material. Examples of cellulose-containing material include but are not limited to any derivative of cellulose such as organic esters (e.g., cellulose acetate, cellulose triacetate, cellulose propionate, cellulose acetate propionate (CAP), cellulose acetate butyrate (CAB)), inorganic esters (e.g., nitrocellulose (cellulose nitrate), cellulose sulfate), cellulose ethers (e.g., alkyl ethers (e.g., methyl cellulose, ethyl cellulose), hydroxyalkyl ethers (e.g., hydroxyethyl cellulose, hydroxypropyl cellulose (ETC), hydroxyethyhnethyl cellulose, hydroxypropylmethyl cellulose (HMPC), ethythydroxyethyl cellulose), carboxyalkyl ethers (e.g., carboxymethyl cellulose (CMC)), regenerated cellulose fibers, or mixtures thereof. In some embodiments, the cellulose-containing material comprises hemicellulose.

In some embodiments, filter elements comprise cellulose acetate tow which can be processed to form a rod. Cellulose acetate tow can be prepared according to various processes known to one skilled in the art. See, for example, the processes forth in U.S. Pat. No. 4,439,605 to Yabune; U.S. Pat. No. 5,167,764 to Nielsen et al.; and U.S. Pat. No. 6,803,458 to Ozaki; which are incorporated herein by reference in their entireties. Typically, cellulose acetate is derived from cellulose by reacting purified cellulose from wood pulp with acetic acid and acetic anhydride in the presence of sulfuric acid. The resulting product is then put through a controlled, partial hydrolysis to remove the sulfate and a sufficient number of acetate groups to produce the required properties for a cellulose acetate that is capable of ultimately forming a rigid or semi-rigid rod. Cellulose acetate can then be extruded, spun, and arranged into a tow. The cellulose acetate fibers can be opened, crimped, or a continuous filament.

In some embodiments, a steam bonding process can be used to produce the cellulose acetate based rods. Further exemplary processes for forming rods of cellulose acetate can be found US Pat. Pub. No. 2012/0255569 to Beard et al, this is incorporated herein in its entirety. In further embodiments, cellulose acetate can be processed using a conventional filter tow processing unit. In addition, representative manners and methods for operating a filter material supply units and filter-making units are set forth in U.S. Pat. No. 4,281,671 to Bynre; U.S. Pat. No. 4,850,301 to Green, Jr. et al.; U.S. Pat. No. 4,862,905 to Green. Jr. et al.; U.S. Pat. No. 5,060,664 to Siems et al.; U.S. Pat. No. 5,387,285 to Rivers and U.S. Pat. No. 7,074,170 to Lanier, Jr. et al; which are incorporated hereby in their entireties.

In some embodiments, the cellulose acetate can be any acetate material of the type that can be employed for providing a tobacco smoke filter for conventional cigarettes. For example, a traditional cigarette filter material is used, such as cellulose acetate tow, gathered cellulose acetate web, or gathered cellulose acetate web. Examples of materials that can be used as an alternative to cellulose acetate include polypropylene tow, gathered paper, strands of reconstituted tobacco, or the like. One filter material that can provide a suitable filter rod, for example, is cellulose acetate tow having 3 denier per filament and 40,000 total denier. As another example, cellulose acetate tow having 3 denier per filament and 35,000 total denier can be used. As another example, cellulose acetate tow having 8 denier per filament and 40,000 total denier can be used. For further examples, see the types of filter materials set forth in U.S. Pat. No. 3,424,172 to Neurath; U.S. Pat. No. 4,811,745 to Cohen et al.; U.S. Pat. No. 4,925,602 to Hill et al.; U.S. Pat. No. 5,225,277 to Takegawa et al. and U.S. Pat. No. 5,271,419 to Arzonico et al.; each of which is incorporated herein by reference in its entirety.

In some embodiments, cellulose acetate fibers can, be mixed with other materials, such as, cellulose, viscose, cotton, cellulose acetate-butyrate, cellulose propionate, polyester (e.g., polyethylene terephthalate (PET), polylactic acid (PLA)), activated carbon, glass fibers, metal fibers, wood fibers, and the like to generate a cellulose-containing material.

In some embodiments, the filter element can comprise a mixture of different types of fibers. Suitable fibers for forming such mixture include, but are not limited to, fibers formed from cellulose acetate, wood pulp, wool, silk, polyesters (e.g., polyethylene terephthalate) polyamides (e.g., nylons), polyolefins, polyvinyl alcohol, fibers functionalized with trapping moieties (e.g., nitrogen, oxygen, sulfur, or phosphorous containing) and the like.

In some embodiments, the filter element can comprise about 1% to about 99% by weight cellulose containing material based on the total dry weight of the filter element. More specifically, the filter element can comprise about 15% to about 80%, about 30% to about 60%, or about 40% to about 50% by weight cellulose containing material (or at least 10%, at least 20%, at least 30%, at least 40%, at least 50%, at least 60%, at least 70%, at least 80%, or at least 90% by weight with an upper boundary of 99%).

In some embodiments, the cellulose-containing material can comprise cellulose acetate fibers and may further comprise a binder. Fillers (e.g., cellulose) and fibers formed of different materials can also be used. The cellulose-containing material can comprise about 70% to about 99% by weight cellulose acetate fibers, based on the total weight of the cellulose-containing material. More specifically, the filter element can comprise about 75% to about 98%, about 80% to about 97.5%, or about 90% to about 97% by weight cellulose acetate fibers. The cellulose containing material can comprise about 1% to about 30% by weight of the binder. More specifically, the cellulose-containing material can comprise about 2% to about 25%, about 2.5% to about 20%, or about 3% to about 10% by weight of the binder, based on the total weight of the cellulose-containing material.

A binder is understood to be a material that imparts a cohesive effect to the fibers used in forming the disclosed filter element. For example, the binder can be a material that partially solubilizes the cellulose acetate fibers such that the fibers bind to each other or to further fibrous materials included in the woven or non-woven filter element. Exemplary binders that can be used include polyvinyl acetate (PVA) binders, starch, and triacetin. One of skill in the art of cigarette filter manufacture may recognize triacetin as being a plasticizer for such filters. As such, it is understood that there may be overlap between the group of binders useful according to the present disclosure and materials that may be recognized in further arts as plasticizers. Accordingly, the cohesion agent used and described herein as a binder may encompass materials that may be recognized in other fields as being plasticizers. Moreover, materials recognized in the field of cigarette filters as plasticizers for cellulose acetate may be encompassed by the use of the term binders herein.

In some embodiments, the cellulose-containing material is mixed with ion exchanged fibers, functionalized with electrophilic or nucleophilic functional groups generally referred to as trapping moieties, to produce the filter element. The trapping moieties bind with one or more target compounds in the generated aerosol thereby removing the target compound(s) from the generated aerosol before reaching the consumer. In some embodiments, if not removed from the generated aerosol the target compound(s) may alter the flavor profile of the aerosol. The atomic functionalization of the trapping moiety is depended upon the atomic structural features of the target compound(s).

The ion exchanged fibers can be mixed with the cellulose-containing material during any step in the above described preparation process to generate the filter element. The ion exchange fibers are typically constructed by imbedding particles of an ion exchange material into the fiber structure or coating the fiber with an ion exchange resin.

Without intending to be bound by theory, it is thought that the atomic functionalization of the trapping moiety carries the opposite charge with respect to the charge carried by the structural features of the target compound. As such, the charged fiber attracts the target compound, which first adsorbs onto the surface of the functionalized fiber and then subsequently forms a covalent bond with the charged functional groups of the fiber to become immobilized.

Generally it is understood that the term "nucleophilic functional group" comprises functional groups with a nucleophilic center (which can be neutral or ionic in nature) as well as ionic moieties such as anions (which carry a negative charge). As such, it is also generally understood that the term "electrophilic functional group" comprises functional groups with an electrophilic center (which can be neutral or ionic in nature) as well as ionic moieties such as cations (which carry a positive charge).

For example, target compounds having electrophilic functional groups generally require trapping moieties with nucleophilic functional groups. Examples of nucleophilic functional groups include but are not limited to basic functional group having a primary amino group (i.e., $—NH_2$), a secondary amino group (i.e., NH(alkyl group), a tertiary amino group (i.e., N(alkyl group)$_2$), a hydrazine group ($—NHNH_2$), a sulfonyl hydrazine group ($—SO_2NHNH_2$) or combinations thereof. In some embodiments, additional nucleophilic functional groups comprise groups including an oxygen atom (e.g., primary alcohol (—OH group), a sulfur atom (e.g., thiol group (—SH)), a phosphorous atom (e.g., phosponate (—$PO_3H$)) or combinations thereof. Any of these nucleophilic functional groups exhibit an affinity for target compound(s) containing electrophilic functional groups such as a carbonyl group (—C═O present in aldehydes, ketones, acids, esters, anhydrides and the like), nitroso group (N—N═O present in nitrosamines), cyanato group (—O—C═N), isocyano groups (—N═C═O), imino group (—C═NH), oxime group (—C═NOH), sulfonyl group ($SO_2$alkyl), sulfino group (—$SO_2H$), sulfo group (—$SO_3H$), thiocyanate group (—SCN), thioyl group (—CSalkyl), alkyl halide (—C-halide), phosphate group ($PO(OH)_3$) and the like.

In some embodiments, target compounds having nucleophilic functional groups generally require trapping moieties with electrophilic functional groups. Examples of electrophilic functional groups include but are not limited to acidic functional groups such as sulfonic acid group (—$SO_3H$), carboxylic acid groups (—COOH), phosphonic acid groups (—$PO_3H$), ester groups (e.g., —COOalkyl group), carboxylic halide groups (—CO-halide), alkyl halide (—C-halide), aldehyde groups (—COH), cyanato group (—O—C═N), isocyano groups (—N═C═O), imino group (—C═NH), oxime group (—C═NOH), sulfonyl group ($SO_2$alkyl), sulfino group (—$SO_2H$), thiocyanate group (—SCN), thioyl group (—CSalkyl), phosphate group ($PO(OH)_3$) or combinations thereof. Any of these electrophilic functional groups exhibit an affinity for target compound(s) containing nucleophilic functional groups such as a primary amino group (i.e., —$NH_2$), a secondary amino group (i.e., NH(alkyl group), a tertiary amino group (i.e., N(alkyl group)$_2$), a hydrazine group (—$NHNH_2$), a sulfonyl hydrazine group (—$SO_2NHNH_2$), oxoanions (e.g. phosphate ion, sulfate ion, sulfite ion, carbonate ion, phosphite ion) and the like. In some embodiments, additional nucleophilic functional groups comprise groups including an oxygen atom (e.g., primary alcohol (—OH group), a sulfur atom (e.g., thiol group (—SH)), a phosphorous atom (e.g., phosponate (—$PO_3H$)) or combinations thereof.

Elements of the filter, such as functionalized fibers, are able to selectively remove, partially or completely, one or more undesirable target compound(s). The selectivity of a functionalized fiber can relate to the functionalization and charge of the trapping moiety. For example, in some embodiments, a trapping moiety comprising a nucleophilic functional group selectively binds a target compound(s) comprising electrophilic functional groups over a target compound(s) comprising nucleophilic functional groups. In another example, a trapping moiety comprising an electrophilic functional group selectively binds a target compound(s) comprising nucleophilic functional groups over a target compound(s) comprising electrophilic functional groups. In addition, fibers comprising an electrophilic or nucleophilic functional group will bind a target compound selectively over any other compounds present in the aerosol such as flavoring compounds and/or other desirable ingredients present in the aerosol. As such a skilled artisan is able to modify the functionalization of the fiber accordingly in order to achieve optimal binding with the desired binding partner (e.g., nucleophilic or electrophilic target compound).

In some embodiments, the filter element binds with one or more target compounds with a defined level of selectivity. For example, at least about 50%, or at least about 60%, or at least about 70%, or at least about 80%, or at least about 90%, or at least about 95% by weight of the total weight of compounds removed by the filter are the one or more target compounds, having an upper boundary of 100%. For example, in some embodiments the target compounds comprise an electrophilic functional group (such as a carbonyl group and/or a nitroso group) and selectively binds with a trapping moiety having a nucleophilic functional group (such as an amine group). In some embodiments such carbonyl-containing compounds comprise aldehydes, ketones, or combinations thereof. In some embodiments, the aldehydes comprise acetaldehyde, acrolein, butyraldehyde, crotonaldehyde, formaldehyde, propionaldehyde, or combinations thereof. In some embodiments such nitroso-containing compounds comprise TSNAs. In some embodiments, the TSNAs comprise N'-nitrosonornicotine (NNN), N'-nitrosoanatabine (NAT), N'-nitrosoanabasine (NAB), 4-(N-nitrosomethylamino)-1-(3-pyridyl)-1-butanone (NNK), 4-(N-nitrosomethylamino)-4-(3-pyridyl)-1-butanal (NNA), 4-(N-nitrosomethylamino)-1-(3-pyridyl)-1-butanol (NNAL), 4-(N-nitrosomethylamino)-4-(3-pyridyl)-1-butanol (iso-NNAL), 4-(N-nitrosomethylamino)-4-(3-pyridyl)-butanoic acid (iso-NNAC), or combinations thereof.

In some embodiments, the filter element exhibits selective binding with one or more carbonyl-containing compounds. For example, at least about 30%, or at least about 50%, or at least about 70%, or at least about 80%, or at least about 90%, or at least about 95% by weight of the total weight of compounds removed by the filter are the one or more carbonyl-containing compounds, having an upper boundary of 100%.

In some embodiments, the filter element exhibits selective binding with one or more aldehydes. For example, at least about 50%, or at least about 60%, or at least about 70%, or at least about 80%, or at least about 90%, or at least about 95% by weight of compounds removed by the filter are the one or more aldehydes, having an upper boundary of 100%.

In some embodiments, the filter exhibits selective binding one or more ketones. For example, at least about 50%, or at least about 60%, or at least about 70%, or at least about 80%, or at least about 90%, or at least about 95% by of compounds removed by the filter are the one or more ketones, having an upper boundary of 100%. In some embodiments, the ketone is acetone.

In some embodiments, the filter element exhibits selective binding with one or more nitroso-containing compounds. For example, at least about 20%, or at least about 30%, or at least about 40%, or at least about 60%, or at least about 70%, or at least about 80%, or at least about 90%, or at least about 95% by weight of the total weight of compounds removed by the filter are the one or more nitroso-containing compounds, having an upper boundary of 100%.

In some embodiments, the filter element exhibits selective binding with one or more TSNAs. For example, at least about 50%, or at least about 60%, or at least about 70%, or at least about 80%, or at least about 90%, or at least about 95% by weight of compounds removed by the filter are the one or more TSNAs, having an upper boundary of 100%.

In some embodiments, the filter element exhibits selective binding with one or more TSNA derivatives. For example, at least about 50%, or at least about 60%, or at least about 70%, or at least about 80%, or at least about 90%, or at least about 95% by weight of compounds removed by the filter are the one or more TSNA derivatives, having an upper boundary of 100%.

In some embodiments, the ion exchange fiber includes the trapping moiety in an amount of at least 10%, or at least 20% or at least 30%, or at least 40%, or at least 50%, or at least 60%, or at least 70%, or at least 80% by weight based on the total weight of the ion exchange fiber, having an upper boundary of 100%.

The ion exchange capacity of the cationic or anionic fiber can vary as well depending on the amount of trapping moiety present on the surface of the fiber. Exemplary ranges can be about 0.5 mmol/g to about 5 mmol/g, preferably about 1 mmol/g to about 3 mmol/g based on the total weight of the cationic fiber.

Exemplary ion exchange fibers are described in U.S. Pat. No. 3,944,485 to Rembaum et al. and U.S. Pat. No. 6,706,361 to Economy et al, both of which are incorporated by reference herein in their entirety. In some embodiments, ion exchange fibers are commercially available from Kelheim Fibers. Exemplary fibers from Kelheim include modified viscose rayon fibers (i.e., regenerated cellulose-based fibers) and their use and preparation is further described in U.S. Pat. Pub. Nos. 2015/0354095 to Bernt; 2015/0329707 to Roggenstein; 2014/0308870 to Harms, 2014/0154507 to Bernt; 2014/0147616 to Bernt and U.S. Pat. No. 9,279,196 to Bernt; U.S. Pat. No. 7,694,827 to Huber; U.S. Pat. No. 6,538,130 to Fischer; U.S. Pat. No. 6,503,371 to Kinseher; U.S. Pat. No. 6,451,884 to Cowen; U.S. Pat. No. 6,392,033 Poggi; U.S. Pat. No. 6,333,108 to Wilkes; and U.S. Pat. No. 5,776,598 to Huber; which are incorporated by reference herein in their entireties.

In some embodiments, the filter element can comprise about 10% to about 99% by weight ion exchange fibers based on the weight of the filter element. More specifically, the filter element can comprise about 15% to about 80%, about 30% to about 60%, or about 40% to about 50% by weight ion exchange fibers based on the total weight of the filter. In further embodiments, the filter element can comprise at least 10%, at least 20%, at least 30%, at least 40%, at least 50%, at least 60%, at least 70%, at least 80%, or at least 90% by weight ion exchange fiber based on the total weight of the filter, with an upper boundary of 99%.

When in use, a user draws on the article 100, airflow is detected by the sensor 108, the heater 134 is activated, and the components for the aerosol precursor composition are vaporized by the heating element 134. Drawing upon the mouth end 111 of the article 100 causes ambient air to enter the air intake 118 and pass through the cavity 125 in the coupler 124 and the central opening in the projection 141 of the base 140. In the cartridge 104, the drawn air combines with the formed vapor to form an aerosol. The aerosol is whisked, aspirated, or otherwise drawn away from the heater 134 and through the filter element 130 towards the opening 128 in the mouth end 111 of the article 100. In some embodiments, the whisked and aspirated aerosol is passed through mouth piece 113.

In some embodiments, an aerosol delivery device having a filter element as described therein can comprise a tank system. Non-limiting examples of tank systems are described in U.S. Pat. Pub. Nos. 2016/0007654 to Zhu; 2016/0192708 to DeMerritt; 2015/011/1110 to Doster; and U.S. Pat. No. 9,078,473 to Worm; and PCT WO 2016/109701 to DeMerritt; which are incorporated herein by reference in their entireties. In some embodiments, the filter comprising the ion-exchange fibers is within the tank system. In some embodiments, the filter comprising the ion-exchange fibers is within a mouthpiece, which is separate from the tank system and can be attached thereto.

Another aspect to the invention is directed towards a method for removing one or more target compounds from a formed aerosol by configuring a filter relative to a heater in an aerosol delivery device such that the aerosol formed in the aerosol delivery device by heating of an aerosol precursor composition by a heater is passed through the filter and one or more target compounds are bound by the filter. The removal of one or more target compounds is determined by measuring a reduction in the level of target compound present in the aerosol before contact with the filter. In some embodiments, the one or more target compounds comprise electrophilic functional groups. In some embodiments, the one or more target compounds are carbonyl-containing compounds, nitroso-containing compounds, or combination thereof. In some embodiments, the one or more target compounds comprise nucleophilic functional groups. In some embodiments, the one or more target compounds are amine-containing compounds (e.g., TSNA derivatives).

In some embodiments, the filter element reduces the level of one or more target compounds present in the generated aerosol by at least about 10%, at least about 20%, at least about 30%, at least about 40%, at least about 50%, at least about 60%, at least about 70%, at least about 80%, at least about 90%, or at least about 95%, compared to the level of one or more target compounds present in the generated aerosol prior to contact with the filter element, with each value being understood to have an upper boundary of 100%.

In some embodiments, the filter element reduces the level of one or more carbonyl-containing compounds present in the generated aerosol by at least about 10%, at least about 20%, at least about 30%, at least about 40%, at least about 50%, at least about 60%, at least about 70%, at least about 80%, at least about 90%, or at least about 95%, compared to the level of one or more carbonyl-containing compounds present in the generated aerosol prior to contact with the filter element, with each value being understood to have an upper boundary of 100%.

In some embodiments, the filter element reduces the level of one or more aldehydes present in the generated aerosol by at least about 10%, at least about 20%, at least about 30%, at least about 40%, at least about 50%, at least about 60%, at least about 70%, at least about 80%, at least about 90%, or at least about 95%, compared to the level of one or more aldehydes present in the generated aerosol prior to contact with the filter element, with each value being understood to have an upper boundary of 100%. For example, in some embodiments, the filter element reduces the level of one or more aldehydes selected from acetaldehyde, acrolein, butyraldehyde, crotonaldehyde, formaldehyde, and propionaldehyde in the aerosol by at least about 10%, at least about 20%, at least about 30%, at least about 40%, at least about 50%, at least about 60%, at least about 70%, at least about 80%, at least about 90%, or at least about 95%, compared to the level of one or more aldehydes present in the generated aerosol prior to contact with the filter element, with each value being understood to have an upper boundary of 100%.

In one or more embodiments, the filter element reduces the combined level of formaldehyde, acetaldehyde, and acrolein in the aerosol by at least about 30%, at least about 50%, or at least about 70%, compared to the level of formaldehyde, acetaldehyde, and acrolein present in the aerosol prior to contact with the filter element, with each value being understood to have an upper boundary of 100%.

In some embodiments, the filter element reduces the level of one or more ketones present in the generated aerosol by at least about 10%, at least about 20%, at least about 30%, at least about 40%, at least about 50%, at least about 60%, at least about 70%, at least about 80%, at least about 90%, or at least about 95%, compared to the level of one or more ketones present in the generated aerosol prior to contact with the filter element, with each value being understood to have an upper boundary of 100%. In some embodiments, the ketone is acetone.

In some embodiments, the filter element reduces the level of one or more nitroso-containing compounds present in the generated aerosol by at least about 10%, at least about 20%, at least about 30%, at least about 40%, at least about 50%, at least about 60%, at least about 70%, at least about 80%, at least about 90%, or at least about 95%, compared to the level of one or more nitroso-containing compounds present in the generated aerosol prior to contact with the filter element, with each value being understood to have an upper boundary of 100%.

In some embodiments, the filter element reduces the level of one or more TSNAs present in the generated aerosol by at least about 10%, at least about 20%, at least about 30%, at least about 40%, at least about 50%, at least about 60%, at least about 70%, at least about 80%, at least about 90%, or at least about 95%, compared to the level of one or more TSNAs present in the generated aerosol prior to contact with the filter element, with each value being understood to have an upper boundary of 100%. For example, in some embodiments, the filter element reduces the level of one or more TSNAs selected from N'-nitrosonornicotine (NNN), N'-nitrosoanatabine (NAT), N'-nitrosoanabasine (NAB), 4-(N-nitrosomethylamino)-1-(3-pyridyl)-1-butanone (NNK), 4-(N-nitrosomethylamino)-4-(3-pyridyl)-1-butanal (NNA), 4-(N-nitrosomethylamino)-1-(3-pyridyl)-1-butanol (NNAL), and 4-(N-nitrosomethylamino)-4-(3-pyridyl)-1-butanol (iso-NNAL), 4-(N-nitrosomethylamino)-4-(3-pyridyl)-butanoic acid (iso-NNAC) in the aerosol by at least about 10%, at least about 20%, at least about 30%, at least about 40%, at least about 50%, at least about 60%, at least about 70%, at least about 80%, at least about 90%, or at least about 95%, compared to the level of one or more TSNAs present in the generated aerosol prior to contact with the filter element, with each value being understood to have an upper boundary of 100%.

In one or more embodiments, the filter element reduces the combined level of NNA and NNK in the aerosol by at least about 30%, at least about 50%, or at least about 70%, compared to the level of NNA and NNK present in the aerosol prior to contact with the filter element, with each value being understood to have an upper boundary of 100%.

In some embodiments, the filter element reduces the level of one or more amine-containing compounds present in the generated aerosol by at least about 10%, at least about 20%, at least about 30%, at least about 40%, at least about 50%, at least about 60%, at least about 70%, at least about 80%, at least about 90%, or at least about 95%, compared to the level of one or more amine-containing compounds present in the generated aerosol prior to contact with the filter element, with each value being understood to have an upper boundary of 100%.

In some embodiments, the filter element reduces the level of one or more TSNA derivatives present in the generated aerosol by at least about 10%, at least about 20%, at least about 30%, at least about 40%, at least about 50%, at least about 60%, at least about 70%, at least about 80%, at least about 90%, or at least about 95%, compared to the level of one or more TSNA derivatives present in the generated aerosol prior to contact with the filter element, with each value being understood to have an upper boundary of 100%. For example, in some embodiments, the filter element reduces the level of one or more TSNA derivatives selected from anabasine, anatabine, nornicotine, 4-(methylamino)-1-(3-pyridyl)-1-butanone in the aerosol by at least about 10%, at least about 20%, at least about 30%, at least about 40%, at least about 50%, at least about 60%, at least about 70%, at least about 80%, at least about 90%, or at least about 95%, compared to the level of one or more TSNA derivatives present in the generated aerosol prior to contact with the filter element, with each value being understood to have an upper boundary of 100%.

In some embodiments, the composition of one or more target compounds (e.g., carbonyl-containing compounds (e.g., aldehydes and ketones) and/or nitroso-containing compounds (e.g., TSNAs)) and/or amine-containing compounds (e.g., TSNA derivatives) present in the generated aerosol as well as their relative levels is dependent upon the initial composition of substances present in the aerosol precursor composition to be vaporized, as would be recognized by a skilled person in the art. A skilled person in the art would further recognize that the level of one or more target compounds (e.g., carbonyl-containing compounds and/or nitroso-containing compounds and/or amine-containing compounds) can vary throughout the use of the aerosol delivery device.

In some embodiments, the filter element binds with one or more target compounds (e.g., aldehydes and/or ketones, or amines). This process is often referred to as "chemisorption" or "adsorption", wherein the target compounds is first attracted to the filter element, then adsorbs and subsequently binds to the filter elements. For example, a bond can form between a carbonyl-containing compound, such as one or more aldehyde and/or ketone, and a functionalized filter element. The filter element can comprise an amine functional group, which can attract the aldehyde and subsequently react to form an immobilized imine-containing compound, which remains bound to the filter element, while the remaining substances in the aerosol are able to pass through the filter element to reach the consumer. In some embodiments, the amount of the target compound (e.g., carbonyl-containing compound) adsorbed and/or bound onto the filter element is dependent upon the ion exchange capacity (e.g., the number of amine functional groups present) of the filter element. For example, in some embodiments, the total amount of target compounds (e.g., carbonyl-containing compounds) adsorbed from the aerosol onto the filter ranges from about 0.2 μg to about 750 μg. In further embodiments, the total amount of target compounds (e.g., carbonyl-containing compounds) adsorbed from the aerosol onto the filter is at least 0.2 μg, or at least 2 μg, or at least 20 μg, or at least 200 μg with an upper boundary of about 750 μg upon completion of the operating time of the aerosol delivery device.

In some embodiments, the filter element binds with one or more nitroso-containing compounds or amine-containing compounds according to the above chemisorption process. In some embodiments, the total amount of target compounds adsorbed from the aerosol onto the filter is at least 0.1 ng, or at least 0.5 ng, or at least 1.0 ng, or at least 3 ng, or at least 5 ng, or at least 10 ng, or at least 20 ng, or at least 30 ng, or at least 40 ng, or at least 50 ng with an upper boundary of about 100 ng upon completion of the operating time of the aerosol delivery device.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

EXAMPLES

Example 1: Collection and Analysis of Mainstream Tobacco Smoke Samples

Step A—Pre-Conditioning of Test Samples

Pre-conditioning of the test samples can vary depending upon the smoking regime being used. For example, pre-conditioning of samples that were smoked according to ISO specifications began at a minimum of 48 hours up to a maximum of 10 days prior to testing. The pre-conditioning temperature ranged from about 69.8° F. to about 73.4° F. and the relative humidity ranged from about 50.0% to about 63.0%. However, if the test samples were stored in a humidity of <45% or >75%, reconditioning or opening of additional sample product was required. Likewise, if the temperature was <61.6° F. or >81.6° F. reconditioning or opening of additional sample products was also required. Even if the humidity or temperature was within the ranges listed but out of specification for >1 hour, reconditioning or opening of additional sample product was required.

After samples were opened, labeled and loaded into the smoke machine, the standard butt length was marked. Generally this length can vary. For example, for ISO specifications the standard butt length to which cigarettes were marked were generally greater than any one of the following three lengths: a) 23 mm; b) length of filter+8 mm; and c) length of filter overwrap+3 mm. Once loaded into the smoke machine samples were ready to be used.

Step B—Collection of Mainstream Tobacco Smoke

Mainstream tobacco smoke is collected in a laboratory setting using a smoke machine. For this experiment, a linear smoke machine (e.g., a Cerulean Linear Smoke Machine) was used to generate and collect mainstream tobacco smoke. The number of cigarettes smoked for each test sample depended upon the smoking regime used and generally ranged from about 2 to about 5 test cigarettes.

The following two smoking regimes were used:

a.) Cambridge Pad, ISO and electronic cigarette Smoking Regimes; and b.) Alternate Smoking regime(s).

A smoke collection system was attached to the smoke machine and a 44-μm Cambridge filter pad was optionally placed behind the collection system. Optionally, the puff volume for each port of the smoke machine being in use could be adjusted accordingly.

For the Cambridge Pad, ISO and electronic cigarette Smoking Regimes, a trapping solution was prepared, and 100 mL of the reagent solution was dispensed into each of the 125-mL gas wash bottles using a pipettor. One gas bottle was used for each replicate of a smoked sample (when electronic cigarettes were smoked the smoke machine was thoroughly cleaned and tubes were replaced prior to use to avoid cross-contamination from burn down samples). For alternate smoking regime(s) a trapping solution was prepared, and 100 mL of the reagent solution was dispensed into each of the 125-mL gas wash bottles using a pipettor. Here, however, two gas wash bottles were used for each replicate of a smoke sample.

After smoking was complete the sample 125-mL gas wash bottles remained untouched for at least 10 minutes but no more than 30 minutes. Pyridine (1.460 mL) was added into each gas bottle with a pipette. For Cambridge Pad, ISO and electronic cigarette Smoking Regimes the solution in the wash bottles was mixed well prior to transferring about 5 mL of the solution from the wash bottle to a 0.45 mm pore size, disposable organic (PFTE) filter to filter the analyte prior to HPLC analysis. For any alternate smoking regime(s) 5 mL aliquots of the sample from each of the two gas wash bottles were taken using a 10 mL automatic pipette and placed into a 20 mL scintillation vial or equivalent. The samples were mixed well and filtered through a 0.45 μm pore size, disposable organic (PFTE) filter prior to HPLC analysis.

HPLC analysis of the above prepared filtered samples was carried out using an Agilent Zorbax Eclipse XDB-C18 column (4.6×100 μm×3.5 μm) connected to an Agilent 2.0 μm particle size pre-column filter or equivalent with mobile phases A (100% water), B (100% acetonitrile), and C (100% tetrahydrofuran) with at a flow rate of 1.1 mL/min and the following gradient:

TABLE 1

| Time (min) | % Water | % Acetonitrile | % Tetrahydrofuran | Curve |
|---|---|---|---|---|
| 0 | 61 | 33 | 6 | |
| 16.0 | 40 | 54 | 6 | 6 |
| 16.1 | 0 | 100 | 0 | 1 |
| 17.3 | 0 | 100 | 0 | 1 |
| 17.5 | 61 | 33 | 6 | 1 |

The raw data obtained was processed as outlined in the next step.

Step C—Analysis of Mainstream Tobacco Smoke

Initially, a series of working standards having concentrations ranging from about 0.400 to about 160.00 μg/mL of 2,4-dinitrophenylhydrazine (DNPH)-aldehyde adducts were prepared (see Table 2).

TABLE 2

| Nominal concentration of working standards (derivatized) | | | | | |
|---|---|---|---|---|---|
| Carbonyl-DNPH (mg/mL) | Standard 1 | Standard 2 | Standard 3 | Standard 4 | Standard5 |
| Formaldehyde-2,4-DNPH | 0.4000 | 0.8000 | 3.200 | 8.000 | 16.00 |
| Acetaldehyde-2,4-DNPH | 4.0000 | 8.0000 | 32.000 | 80.000 | 160.00 |
| Acetone-2,4-DNPH | 2.0000 | 4.0000 | 16.000 | 40.000 | 80.000 |
| Acrolein-2,4-DNPH | 0.8000 | 1.600 | 6.400 | 16.000 | 32.000 |
| Crotonaldehyde-2,4-DNPH | 0.2000 | 0.4000 | 1.600 | 4.000 | 8.000 |
| Propionaldehyde-2,4-DNPH | 0.8000 | 1.600 | 6.400 | 16.000 | 32.00 |
| 2-Butanone-2,4-DNPH | 0.8000 | 1.600 | 6.400 | 16.000 | 32.00 |
| Butyraldehyde-2,4-DNPH | 0.5000 | 1.000 | 4.000 | 10.000 | 20.00 |

The corresponding carbonyl concentrations were calculated by dividing the working standard concentrations in table 1 by the appropriate ratio of the formula weights of free carbonyl compound to the corresponding DNPH-carbonyl adduct (see Table 3).

TABLE 3

| Nominal concentration of working standards (free carbonyl) | | | | | |
|---|---|---|---|---|---|
| Free carbonyls (mg/mL) | Standard 1 | Standard 2 | Standard 3 | Standard 4 | Standard 5 |
| Formaldehyde | 0.05716 | 0.1143 | 0.4573 | 1.143 | 2.286 |
| Acetaldehyde | 0.7860 | 1.572 | 6.288 | 15.72 | 31.44 |
| Acetone | 0.4877 | 0.9754 | 3.901 | 9.754 | 19.51 |
| Acrolein | 1.899 | 0.3798 | 1.519 | 3.798 | 7.596 |
| Crotonaldehyde | 0.05602 | 0.1120 | 0.4482 | 1.120 | 2.241 |
| Propionaldehyde | 0.1951 | 0.3901 | 1.561 | 3.901 | 7.803 |
| 2-Butanone | 0.2287 | 0.4574 | 1.830 | 4.574 | 9.148 |
| Butyraldehyde | 0.1429 | 0.2859 | 1.144 | 2.859 | 5.718 |

These standards are used to generate the calibration curves of the individual aldehydes. However, initial calibration verification (ICV) of the HPLC instrument was carried out with an ICV standard. Such a standard was prepared by diluting a certified standard, and aldehyde/ketone DNPH mix containing approximately 15.00 μm/mL of each carbonyl obtained from Restek. 15 mg/mL carbonyl mix was diluted by adding 667 μL of the mix into a 10 mL volumetric flask (or other amount as long as the ratio stays the same, e.g., 1.668 mL of mix in a 25 mL volumetric flask) and brought to volume using acetonitrile to prepare a ICV standard solution with 1 μg/mL concentration. This ICV standard remains stable in the freezer (−25 to −5° C.) for about 3 months. In general, the ICY should be within 15% of the target value, except for acetaldehyde, which should be within 20% of the target value.

Next, raw data for the generation of calibration curves of the standards in table 2 were collected. Openlab software was used to perform the linear regression calculations. Calibration curves were reviewed to ensure that all injections were identified and all correlation coefficients were equal to or greater than 0.990. Openlab software ensured that none of the calibration curves were forced through zero.

During analysis of the smoke samples obtained from the smoke machine, the height/area relative standard deviation (RSD) of each analyte was typically ≤8% and the retention time RSD was typically ≤2%. The RSD for the majority of the samples is generally less than 25% although e-cigarette samples can exhibit and RSD greater than 25%. All analytes were integrated by peak height except acetaldehyde, which eluted as two peaks and was integrated by peak area (both peaks were integrated). Results are expressed in μg/cig and μg/puff and may be calculated manually according to the following equations:

$$\textit{ISO}\ \text{Method}\ (\mu g) = \frac{[\text{Peak height of analyte} - \text{y-intercept} \times 101.46\ \text{mL}]}{\text{Slope}}$$

$$\text{Alternate smoking methods}\ (\mu g) = \frac{[\text{Peak height of analyte} - \text{y-intercept}] \times 202.92\ \text{mL}}{\text{Slope}}$$

The standard values of 101.46 and 202.92 are the combined, volumes of the impinger plus the volume of pyridine respectively for the two smoking regimes. The final amount of analyte is determined by:

$$\text{Analyte}\ (\mu g/\text{cigt}) = \frac{\text{Analyte amount}\ (\mu g)}{\#\ \text{cigts. Smoked}}$$

$$\text{Analyte}\ (\mu g/\text{puff}) = \frac{\text{Analyte amount}\ (\mu g)}{\#\ \text{of puffs}}$$

That which is claimed:

1. An aerosol delivery device comprising:

a vaporization component configured for vaporization of an aerosol precursor composition to subsequently form an aerosol optionally including one or more target compounds;

a filter comprising a cellulose-containing material and ion-exchanged fibers including functional groups selected from nucleophilic functional groups and electrophilic functional groups, the filter being operatively arranged relative to the vaporization component such that at least a portion of the formed aerosol passes therethrough, the filter being configured to bind selectively one or more of the target compounds;

wherein the one or more target compounds comprise one or both of carbonyl-containing compounds and nitroso-containing compounds.

2. The aerosol delivery device of claim 1, wherein the amount of cellulose-containing material in the filter ranges from about 1 to about 99% by weight based on the total weight of the filter.

3. The aerosol delivery device of claim 1, wherein the amount of ion-exchanged fiber in the filter ranges from about 1 to about 99% by weight, based on the total weight of the filter.

4. The aerosol delivery device of claim 1, wherein the cellulose-containing material comprises one or more of cellulose acetate, cellulose triacetate, cellulose propionate, cellulose acetate propionate, cellulose acetate butyrate, nitrocellulose, cellulose sulfate, methyl cellulose, ethyl cellulose, hydroxyethyl cellulose, hydroxypropyl cellulose, hydroxyethylmethyl cellulose, hydroxypropylmethyl cellulose, ethylhydroxyethyl cellulose, carboxymethyl cellulose and regenerated cellulose fibers.

5. The aerosol delivery device of claim 4, wherein the cellulose-containing material is cellulose acetate.

6. The aerosol delivery device of claim 1, wherein the nucleophilic functional groups are selected from a primary amino group, a secondary amino group, a tertiary amino group, a hydrazine group, a benzenesulfonyl hydrazine group, and combinations thereof.

7. The aerosol delivery device of claim 6, wherein the nucleophilic functional groups are a primary amine group or a secondary amine group.

8. The aerosol delivery device of claim 1, wherein the carbonyl-containing compounds comprise aldehydes, ketones, or combinations thereof.

9. The aerosol delivery device of claim 8, wherein the carbonyl-containing compounds are at least one aldehyde.

10. The aerosol delivery device of claim 9, wherein the aldehyde comprises at least one or more of acetaldehyde, acrolein, butyraldehyde, crotonaldehyde, formaldehyde, or propionaldehyde.

11. A method for removing target compounds from a formed aerosol, the method comprising:

configuring a filter element relative to a vaporization component in an aerosol delivery device such that an aerosol formed in the aerosol delivery device from an aerosol precursor composition subsequent to vaporization thereof is passed through the filter element, and one or more target compounds in the aerosol are bound by the filter element;

wherein the filter element comprises a cellulose-containing material and ion-exchanged fibers including functional groups selected from nucleophilic functional groups and electrophilic functional groups;

wherein the one or more target compounds comprise one or both of carbonyl-containing compounds and nitroso-containing compounds, or combinations thereof.

12. The method of claim 11, wherein the carbonyl-containing compounds comprise aldehydes, ketones, or combinations thereof.

13. The method of claim 12, wherein the carbonyl-containing compounds comprise at least one aldehyde.

14. The method of claim 13, wherein the at least one aldehyde is one or more of acetaldehyde, acrolein, butyraldehyde, crotonaldehyde, formaldehyde, or propionaldehyde.

15. The method of claim 11, wherein the nitroso-containing compounds comprise N'-nitrosonornicotine (NNN), N'-nitrosoanatabine (NAT), N'-nitrosoanabasine (NAB), 4-(N-nitrosomethylamino)-1-(3-pyridyl)-1-butanone (NNK), 4-(N-nitrosomethylamino)-4-(3-pyridyl)-1-butanal (NNA), 4-(N-nitrosomethylamino)-1-(3-pyridyl)-1-butanol (NNAL), 4-(N-nitrosomethylamino)-4-(3-pyridyl)-1-butanol (iso-NNAL), 4-(N-nitrosomethylamino)-4-(3-pyridyl)-butanoic acid (iso-NNAC), or combinations thereof.

* * * * *